US005207527A

United States Patent [19]

Duncan et al.

[11] Patent Number: 5,207,527

[45] Date of Patent: May 4, 1993

[54] SYSTEM SCAFFOLD WEDGING ARRANGEMENT

[76] Inventors: Warren Duncan, 2725 Fremont La., Costa Mesa, Calif. 92626; Dwight Allenbaugh, 7520 Monroe St., Paramount, Calif. 90723

[21] Appl. No.: 867,964

[22] Filed: Apr. 13, 1992

[51] Int. Cl.[5] ..... B25G 3/00

[52] U.S. Cl. ..... 403/246; 403/49; 182/179

[58] Field of Search ..... 403/49, 256, 246; 182/179

[56] References Cited

U.S. PATENT DOCUMENTS

| | | | |
|---|---|---|---|
| 4,394,095 | 7/1983 | Layher | 403/49 |
| 4,603,756 | 8/1986 | Layher | 403/49 X |
| 4,840,513 | 6/1989 | Hackett | 403/246 X |

*Primary Examiner*—Andrew V. Kundrat

*Attorney, Agent, or Firm*—Charles H. Thomas

[57] ABSTRACT

A connection system is provided for use with scaffolding to secure laterally extending support members to upright standards. Latching rings permanently secured at intervals along the upright standards are provided with primary latching openings, each of which has a central region of limited breadth with oppositely directed narrower radial elongations of uniform width throughout. The radial elongations of the primary latching openings are located so as to reside in vertical registration with longitudinally elongated apertures formed in flanges of brackets that are secured to laterally extending scaffold support elements. Wedges are carried by the brackets and can be fully engaged only when the laterally extending support members are in precise, orthogonal alignment relative to the upright standards. Preferably, secondary latching ring openings are provided to accommodate diagonal braces to enhance the rigidity of the scaffolding support.

12 Claims, 4 Drawing Sheets

SYSTEM SCAFFOLD WEDGING ARRANGEMENT

BACKGROUND OF THE INVENTION

1. Field of the Invention

The present invention relates to a connecting arrangement for interconnecting upright standards and lateral cross connecting members for supporting scaffolding.

2. Description of the Prior Art

In systems scaffolding rigid tubular members are employed to support elevated walkways and platforms to allow workers to perform tasks at elevated levels. In system scaffolding sections of hollow steel tubing, which may, for example, be two inches in diameter, are employed both as upright and as cross connecting members. The upright tubular members are referred to as uprights standards. At their bases the upright standards are often equipped with screw jacks which can be operated to adjust the elevation of an upright standard.

Upright standards are cross connected together by laterally extending scaffold supports, which are also formed of hollow steel tubing. Lengthy, horizontally disposed laterally extending supports are referred to in the trade as runners, while shorter horizontally disposed members are termed bearers. The bearers and runners are typically four to six feet in length. Runners and bearers are frequently secured to upright standards by means of latching or connecting rings which are permanently secured to the upright standards at spaced intervals therealong. Runners and bearers extend between latching rings at the same elevation on adjacent standards. In addition, diagonal braces interconnect latching rings at certain levels on upright standards to latching rings at different elevations on other upright standards.

In most scaffold latching ring arrangements an annular generally disk-shaped latching ring is welded or otherwise permanently secured to an upright standard. The lateral scaffolding supports are provided with interconnecting brackets at their extremities. These brackets typically have upper and lower horizontally disposed flanges, both of which have vertically aligned openings therethrough. To removably secure a lateral scaffolding support to an upright standard the flanges on the bracket of a lateral scaffolding support are brought into vertical alignment with a latching ring on an upright standard so that the upper flange lies above the latching ring and the lower flange is disposed beneath the latching ring. The brackets are also provided with removable wedge shaped latching members which can be lowered down through the aperture in the upper flange, through a vertically aligned latching opening in the latching ring, and through the aperture in the lower flange. The end of the lateral scaffolding support is thereby releasably attached to the upright standard at a desired elevation.

The ends of the various lateral scaffolding supports are connected to the various rings on a number of upright standards to form a scaffolding structure. Typical conventional scaffold support connecting arrangements are described in U.S. Pat. Nos. 4,493,578; 4,840,513; 4,587,786; 4,394,095; 4,044,523; and 4,180,342, for example.

One problem which has persisted in conventional systems scaffolding connection arrangements in which a wedge is employed to secure the bracket of a lateral scaffolding support to a latching ring is that the conventional systems herebefore available are all capable of being assembled out of square. That is, the coupling mechanisms allow the horizontal lateral scaffolding supports to be coupled at slight deviations from precise radial alignment relative to the upright standards. As the scaffolding increases in number of levels, the slight misalignment is cumulative with each level, so that the levels of scaffolding twist further and further out of square the higher up the scaffolding goes. This departure from precise orthogonal alignment, which is multiplied with each interconnecting horizontal level, can cause the scaffolding to be unstable to the point where it is no longer structurally sound.

Different connecting systems have been devised to attempt to ensure precise orthogonal alignment of the scaffolding members. For example, U.S. Pat. No. 4,044,523 describes a system in which four substantially "barrel shaped" openings are defined in a latching ring. The theory of operation of this system is that even if the flange openings are slightly out of radial alignment with the upright standard to which the lateral supporting member is to be connected, the act of driving the wedge downwardly into the "barrel shaped" latching ring opening will cause the wedge to rotate slightly about a vertical axis so that the increasing width of the portion of the wedge in the radial direction at that level can enter the latching ring opening. The twisting action of the wedge is transmitted to the bracket, which in turn is supposed to bring the lateral support into orthogonal alignment. The structure of the wedge in effect is supposed to act as a lever to rotate a runner or bearer in a horizontal plane. The problem with this system, however, is that the lever arm provided by the wedge is simply too short to perform the desired correction effectively. Since the edge of the wedge which bears laterally against the side of the latching ring opening is no more than one and one half inches from the face of the upright standard or fulcrum point, the lever arm is simply too short to bring a bearer or runner several feet in length into orthogonal alignment. Due to the tolerance in the fit of the wedge into the latching ring opening and the distortion to both the wedge and the latching ring which can result from driving the wedge into the opening at a small angle of misalignment, it is possible for the wedge to be completely seated while the bearer or runner carrying the bracket into which the wedge is driven remains slightly misaligned.

Another system which has attempted to solve the problem of misalignment is described in U.S. Pat. No. 4,587,786. In this system the openings in the latching ring are shaped substantially as truncated arcuate sectors of a circle in which a notch is defined at the center of the radially inwardly facing edge of the latching ring opening. A wedge driven into the latching ring opening is not supposed to seat unless it is centered precisely within the lateral confines in the notch in the outer wall of the opening. However, in this system the front of the wedge closest to the upright standard is not stabilized sufficiently and the tolerances provided by the notch are not sufficient to prevent the wedge from being driven into the latch ring opening at an angle of slight misalignment relative to precise orthogonal, radial orientation with respect to an upright standard.

SUMMARY OF THE INVENTION

It is an object of the present invention to provide a connecting apparatus for use in joining upright and laterally disposed scaffolding support members in a manner such that precise, orthogonal alignment of the horizontal lateral scaffold supports and the upright standards is ensured. Unlike the prior systems which have attempted to maintain precise orthogonal alignment between the various scaffolding supports, the connecting apparatus of the present invention is not capable of being secured in a state of misalignment. To the contrary, if one attempts to drive the wedge through the latching ring aperture with the lateral scaffolding support with which it is associated out of precise radial alignment, the wedge will simply not advance into a fully seated position. This will be apparent to the installer, since a very substantial portion of the wedge will project above the upper flange of the bracket. Continued blows applied to the wedge to attempt to seat it with the lateral scaffolding support held in misalignment with the upright standard will have no effect.

However, even when the lateral support is initially misaligned and before the wedge can be completely seated, the tip of the wedge will engage the latching ring opening. This provides a fulcrum about which the user can swing the bearer or runner in a horizontal plane to bring that member into precise radial alignment relative to the upright standard to which it is to be attached. When the horizontal lateral support is brought into precise radial registration with the standard, then, and only then, can the wedge be fully driven into seated engagement.

In one broad aspect the present invention may be considered to be a scaffold support connecting apparatus for use in connecting lateral scaffolding supports to upright scaffolding standards. The apparatus is comprised of an annular latching ring, a bracket, and a wedge of particular construction.

Specifically, the annular latching ring is disposed concentrically about an upright standard and is permanently secured thereto and formed with a plurality of orthogonally arranged primary latching openings therein. Each of the primary latching openings has a relatively broad central region with radially opposite elongations extending therefrom to define radial inner and outer end surfaces and side surfaces with convex transitions between the central region and the radial elongations. The radial elongations are narrower in transverse width than the central region.

The bracket is permanently secured to an elongated lateral support and includes upper and lower horizontally disposed flanges which are vertically spaced from each other. Each flange has a longitudinally directed exposed end extremity with a contact edge. The flanges are formed with longitudinally elongated apertures. The width of the elongated aperture in the upper flange is uniform throughout and is equal to the transverse width of the radial elongations of the primary latching openings. The leading ends of the apertures in the flanges closest to the contact edges are vertically aligned with each other.

The wedge has a uniform thickness in a transverse direction to span the transverse width of the radial elongations in the primary latching openings. The wedge has an upper portion that decreases in thickness in a longitudinal direction from top to bottom. The front of the upper portion of the wedge is linear. The wedge also has a lower portion that forms an obtuse angle with the front of the upper portion.

The wedge is captured in the bracket and is movable in a vertical plane between a disengaged position resting upon the upper flange with the front of the upper wedge portion inclined relative thereto and with the lower wedge portion located between the upper and lower flanges, and a fully engaged position when the latching ring resides between the upper and lower flanges and the bracket is in radial alignment with the radial elongations of a selected primary latching opening. In the fully engaged position the wedge passe through the apertures in the flanges and through the selected latching opening in the latching ring. In this position the wedge bears against the leading ends of the elongated apertures in the flanges and against the radial outer end surface of the selected primary latching opening.

The invention may be described with greater clarity and particularity with reference to the accompanying drawings.

DESCRIPTION OF THE EMBODIMENT

Figure 1:
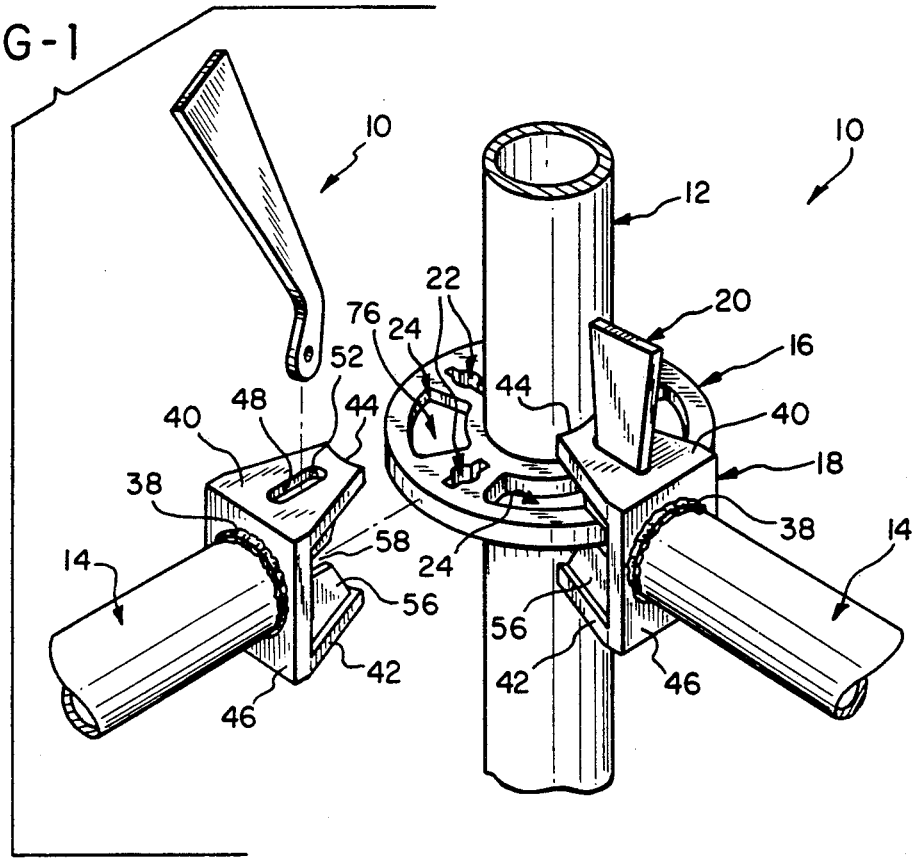
FIG. 1 is a perspective view illustrating the connection system according to the invention.

FIG. 1 is a perspective view illustrating two identical connection systems according to the invention, one of which is illustrated in an exploded view. Each of the connection systems is indicated generally at 10. Each connection system 10 includes apparatus for connecting upright scaffolding supporting standards 12 and laterally extending members 14 for interconnecting those standards. The apparatus of the invention in the connection systems 10 is comprised of annular latching rings 16, brackets 18, and wedges 20.

A scaffolding support system is formed by a number of laterally spaced, upright standards 12 which are cross connected together by longitudinally extending members 14. Each upright standard 12 has a plurality of latching rings 16 spaced along its length, and the longitudinally extending members 14 ar secured to the upright standards 12 at the latching rings 16. Each annular latching ring 16 has an overall disk-shaped configuration and is permanently secured by welds to a hollow, upright steel tube forming an upright standard 12. The latching ring 16 extends radially outwardly from the upright standard 12 which passes axially through the center of the latching ring 16. The latching ring 16 has four orthogonally spaced primary latching openings 22 therethrough equally spaced about the periphery of the latching ring 16, and four secondary latching openings 24 therethrough spaced between the primary latching openings 22.

Figure 2:
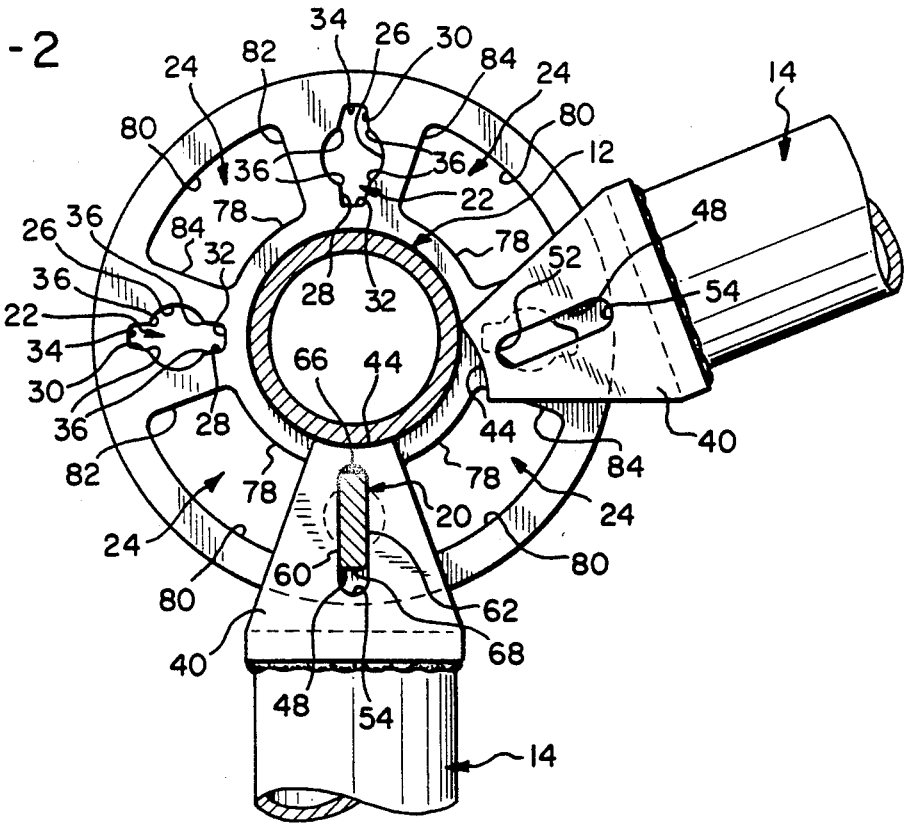
FIG. 2 is a top plan view illustrating the connection system of FIG. 1.

As best illustrated in FIG. 2, each primary latching opening 22 has a central region 26 of limited, lateral breadth and also radially extending elongations 28 and 30 of uniform transverse width throughout. The central region 26 of each primary latching opening 22 has a generally circular configuration and the radial elongations 28 and 30 are of a uniform transverse width throughout that is narrower than the breadth or diameter of the central region 26. The elongations 28 and 30 extend radially in opposite directions to define a radially outwardly facing end surface 32 proximate to the standard 12 and a radially inwardly facing end surface 34 remote from the standard 12. The end surfaces 32 and 34 are separated from each other by a distance greater than the lateral breadth or diameter of the central region 26. The radial elongations 30 and 28 have parallel side surfaces. There are convex transitions, indicated at 36, between the central region 26 and the side surfaces of the radial elongations 28 and 30. The configuration of the primary latching openings 22 is such that the radial elongations 28 and 30 form oppositely directed radial keyways from the generally circular central region 26.

A bracket 18 is permanently secured by welding, as indicated at 38 to each of the opposite ends of the laterally extending scaffold support members 14. The members 14 may be horizontally disposed runners or bearers. The brackets 18 at the ends of the elongated members 14 are used to couple the laterally extending members 14 to the latching rings 16 so as to interconnect the upright standards 12 together. Each bracket 18 includes vertically spaced, horizontally disposed, flat, generally trapezoidal shaped upper and lower flanges 40 and 42. The upper and lower flanges 40 and 42 extend longitudinally from the elongated support 14 from a transverse mounting plate 46 that is welded across the end of the elongated support 14. Each flange 40 and 42 has an end extremity with a leading edge 44 thereon. The leading edges 44 are of arcuate concave configuration having the same radius as the outer convex surface of the standard 12 and ar configured to conform to the surface of the standard 12.

Longitudinally elongated apertures 48 and 50 are formed in the upper flange 40 and the lower flange 42, respectively. Each of the apertures 48 and 50 is formed with a forward limiting end surface 52 and a rearward limiting end surface 54. The elongated apertures 48 and 50 have a uniform width throughout, as measured perpendicular to the longitudinal alignment of the elongated support 14. The width of the elongated aperture 48 is equal to the transverse width of the elongations 28 and 30 of the primary latching openings 22 as measured between the side edges of those radial elongations adjacent the end surfaces 32 and 34 thereof.

In the embodiment of the connecting system 10 illustrated the forward and rearward limiting end surfaces 52 and 54 of the elongated apertures 48 and 50 are both rounded. The forward limiting end surfaces 52 of the elongated apertures 48 and 50 are vertically aligned with each other. The rearward end surface 54 of the lower flange 42 is more distant from the leading edge 44 thereof than is the rearward end surface 54 of the elongated aperture 48 of the upper flange 40.

Spacing webs 56 extend vertically toward each other from the mutually facing inner surfaces of the flanges 40 and 42, but do not meet. Instead, they define a gap 58 therebetween. The gap 58 is of a width just sufficient to receive the peripheral edge of the latching ring 16. The spacing webs 56 thereby ensure that the elongated support 14 is vertically centered on the latching ring 16.

A wedge 20 is provided for each bracket 18. Each wedge 20 has a uniform transverse width throughout as measured between the opposing longitudinally extending surfaces 60 and 62. The transverse width of each wedge 20 is selected to span the transverse width of the radial elongations 28 and 30 of the primary latching openings 22.

Each wedge 20 has an upper portion 64 that has a linear, forwardly facing longitudinally straight, transversely rounded front 66. The rear 68 of the upper portion 64 is also transversely rounded. The upper portion 64 of each wedge 20 tapers from top to bottom in a longitudinal direction a measured between the front 66 and rear 68. The front 66 and rear 68 of the wedge 20 converge toward a neck 70 at the bottom of the upper portion 64. From the neck 70 a lower portion 72 of the wedge 20 extends downwardly at an obtuse angle relative to the linear front 66 of the upper portion 64. The bulbous tip of the lower portion 72 is rounded, as illustrated in FIGS. 3–7.

Figure 3:
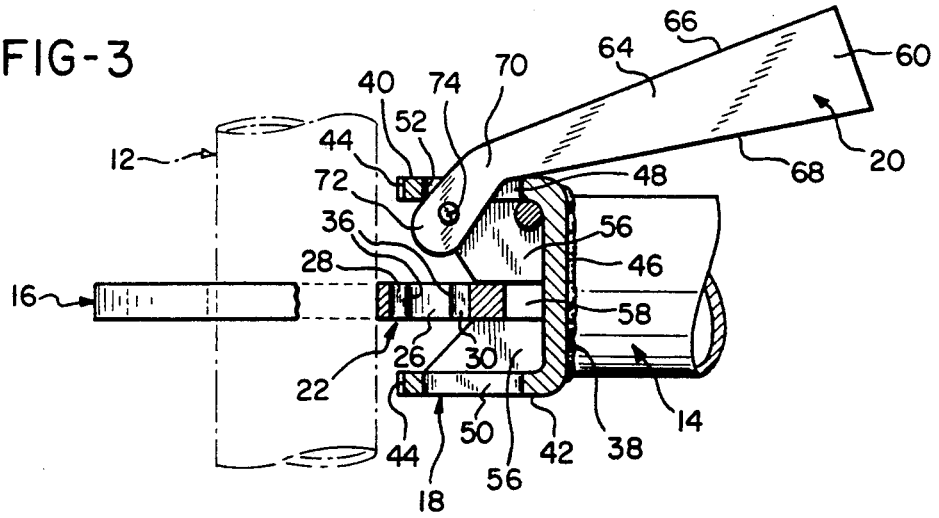
FIG. 3 is a side elevational view illustrating the wedge of the connection system in a disengaged position.
Figure 4:
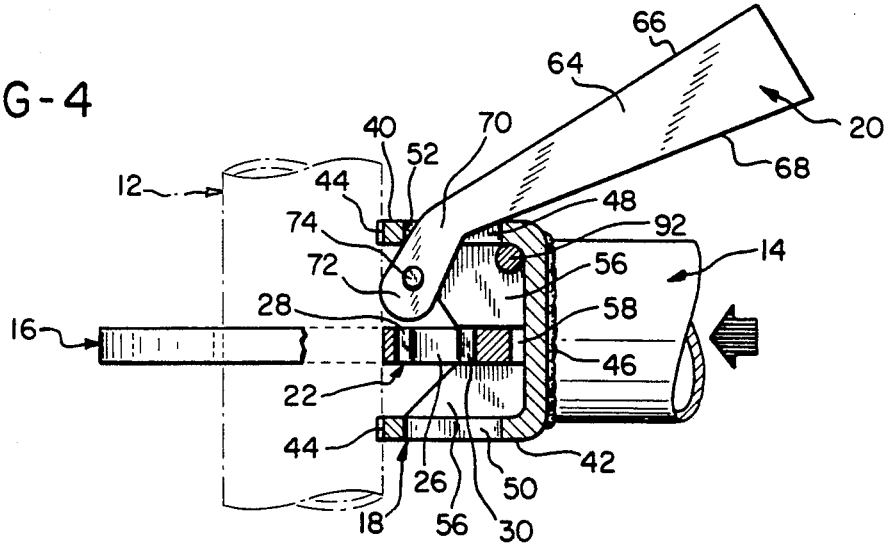
FIG. 4 is a side elevational view illustrating the preliminary movement of the wedge of the connection system from the disengaged position toward an engaged position.
Figure 5:
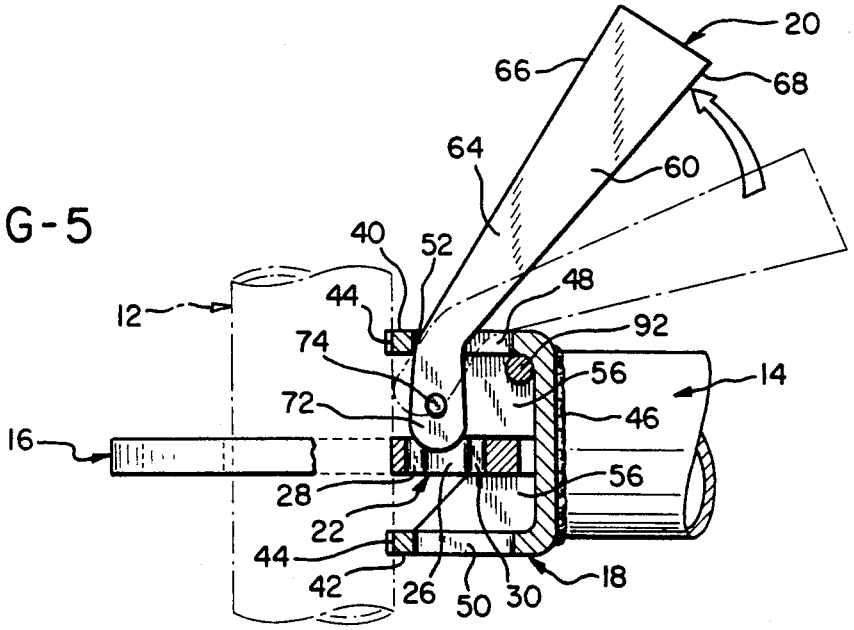
FIG. 5 illustrates further movement of the wedge of the connection system of the invention toward an engaged position.

A transverse rivet 74 is attached to the side 60 of the lower portion 72 of the wedge 20 to prevent the wedge 20 from being separated completely from the bracket 18. The rivet 74 extends laterally outwardly from the plane of the side 60 of the wedge 20 a sufficient distance so that it will not pass through the elongated aperture 48 in the upper flange 40. The aperture 50 in the lower flange 42 is wider in a transverse direction than the aperture 48 so that the rivet 74 will pass through the aperture 50. Likewise, the rivet 74 can pass through the central region 26 of a primary opening 22 in the latching ring 16. Thus, the wedge 20 can be withdrawn upwardly until it abuts against the underside of the upper flange 40, as illustrated in FIG. 3. Since the rivet 74 will not pass through the aperture 48 in the upper flange 40, however, the wedge 20 cannot become separated from the bracket 18 and lost. The rivet 74 thereby serves to allow the bracket 18 to capture the wedges 20, although the wedge 20 is movable relative to the bracket 18 in a vertical plane to the limit allowed by the rivet 74.

The wedge 20 is illustrated in a completely disengaged position in FIG. 3 in which the upper wedge portion 64 rests atop the upper flange 40 with the lower wedge portion 72 depending therebeneath and residing above the lower flange 42. With the wedge 2 in the disengaged position depicted in FIG. 3 the lateral support member 14 can be drawn away from the upright standard 12 in a horizontal plane and removed from the latching ring 16 entirely.

Conversely, when a longitudinally extending runner or bearer 14 is to be connected to the upright standard 12, it is moved in a horizontal plane toward a latching ring 16 on the upright standard 12 with the wedge 20 in the disengaged position depicted in FIG. 3. The longitudinally extending support member 14 is normally thrust toward the upright support member 12 so that the leading, contacting edges 44 of the flanges 40 and 42 strike the surface of the upright support 12.

The tip of the lower portion 72 of the wedge 20 may project longitudinally outwardly from the bracket 18 beyond the contact edges 44 when the wedge 20 is in the disengaged position of FIG. 3 so as to impact against the outer surface of the upright standard 12 before the contact edges 44 do so. This will tend to tip the wedge 20 in a counterclockwise direction, as viewed in FIGS. 3–7. Alternatively, the inertia of the wedge 20 moving toward the upright standard 12 when the longitudinal support member 14 is thrust toward the upright standard 12 may be sufficient to initiate counterclockwise rotation of the wedge 20 when the contact edges 44 of the flanges 40 and 42 impact against the outer surface of the upright standard 12. In either event the wedge 20 rotates in a vertical plane in a counterclockwise direction as viewed in FIGS. 3–7 from the position depicted in FIG. 3 to that depicted in FIG. 4. The momentum of the wedge 20 is sufficient to carry it in counterclockwise rotation from the position shown in FIG. 4. to the position of FIG. 5, whereupon the tip of the lower portion 72 of the wedge 20 enters into the central region 26 of a selected primary latching opening 22 with which the longitudinal support member 14 has been roughly aligned.

Figure 6:
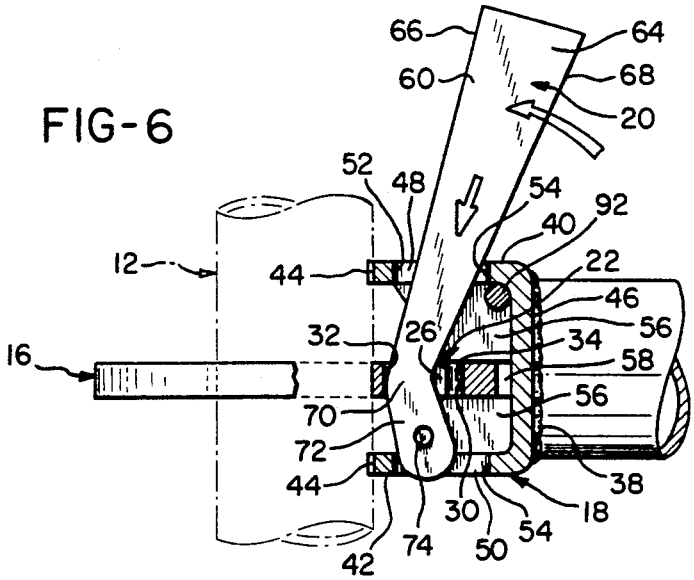
FIG. 6 illustrates still further movement of the wedge of the connection system of the invention toward an engaged position.
Figure 7:
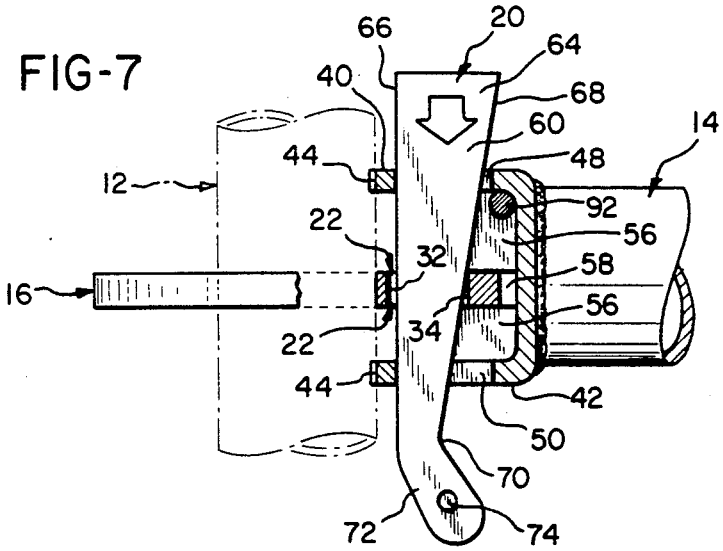
FIG. 7 illustrates the wedge of the connection system of the invention in a fully engaged position.

If the longitudinal support member 14 is in precise radial alignment with the upright standard 12 the wedge 20 will continue its counterclockwise movement as depicted in FIG. 6, and can be driven into a fully engaged position depicted in FIG. 7 by blows applied to the top of the wedge 20. In this position the upper wedge portion 64 extends down through the apertures 48 and 50 in the upper flange 40 and the lower flange 42 and also through the selected primary latching opening 22. In this position the front 66 of the wedge 20 bears against the forward limiting end surfaces 52 of the apertures 48 and 50 in the upper and lower flanges 40 and 42, respectively, and also against the radially inwardly facing surface 34 of the selected primary latching opening 22.

More typically, however, the elongated longitudinally extending member 14 will not be in precise radial alignment with the upright standard 12 when it is first thrust thereagainst, whereupon the standard abutment or contact edges 44 establish contact with the outer surface of the upright standard 12. Such a misalignment is depicted in exaggerated form on the right hand side of FIG. 2 of the drawings. Under such conditions the momentum of the wedge 20 will cause the wedge to rotate in a counterclockwise direction, as viewed in FIGS. 3–7, but only to about the extent depicted solid lines in FIG. 5. Under such circumstances the lower portion 72 of the wedge 20 will extend into the central region 26 of the selected primary opening 22, but the upper portion 64 of the wedge 20 cannot be forced downwardly any further since its thickness in the longitudinal direction between the front 66 and the back 68 is too great to pass through the limited lateral breadth of the central region 26. Even if blows are applied to it the wedge 20 cannot be advanced further until the elongated support member 14 is brought into precise radial alignment with the upright standard 12.

The process of bringing the elongated longitudinal support 14 into proper radial alignment with the upright standard 12 is facilitated by the partial engagement of the lower portion 72 of the wedge 20 in the central region 26 of the selected primary opening 22. The lower portion 72 of the wedge 20 thereby acts as a pivot pin or fulcrum by virtue of its preliminary engagement in the central region 26, and the elongated longitudinally extending member 14 can be swung in a horizontal plane in an arc about the lower portion 72 of the wedge 20 without drawing the longitudinally extending member 14 away from the upright standard 12.

The scaffolding installer will know that the longitudinally extending member 14 is in precise radial alignment with the upright standard 12 when, upon delivering blows to the top of the wedge 20, the upper portion 64 of the wedge 20 can be driven downwardly so that the front 66 and the back 68 of the wedge 20 respectively enter into the inward radial elongation 28 and the outer radial elongation 30 of the selected primary opening 22. When precise radial alignment is achieved in this manner the wedge 20 can be driven into complete engagement with the upper portion extending into the radial elongations 28 and 30 of the selected primary opening 22 as depicted in FIG. 7 and at the bottom of FIG. 2.

As illustrated in FIGS. 3–7, each bracket 18 includes a means for limiting movement of the wedge 20 such that the top of the upper portion 64 of the wedge 20 can never rest in a position closer to the upright standard 12 than the bottom of the upper portion 64. That is, with reference to FIGS. 6 and 7, the wedge 20 can never rotate to the extent that the front 66 of the upper portion 64 passes beyond the vertical alignment depicted in FIG. 7.

The function of preventing excessive rotation of the wedge 20 is performed by a short length of barstock 92 that is welded on the inside of the junction of the upper flange 40 with the back plate 46. The barstock 92 is preferably formed of solid steel, typically about one half inch in diameter.

The barstock 92 serves as a block that prevents the tip of the lower portion 72 of the wedge 20 from lodging in the area above the latching ring 16 and beneath the upper flange 40. The barstock 92 serves to prevent excessive rotation of the upper portion 64 of the wedge 20 toward the upright standard 12 so that the lower portion 72 of the wedge 20 cannot approach the inside surface of the mounting plate 46 and hang up in the region between the latching ring 16 and the upper flange 40. The barstock 92 deflects the wedge so that the lower portion 72 thereof is directed into the central region 26 of the primary opening 22. This allows the wedge 20 to be properly guided into the fully engaged position depicted in FIG. 7 when the elongated slots 48 and 50 are in precise radial alignment with the radial elongations 28 and 30 of the primary latching openings 22.

Figure 10:
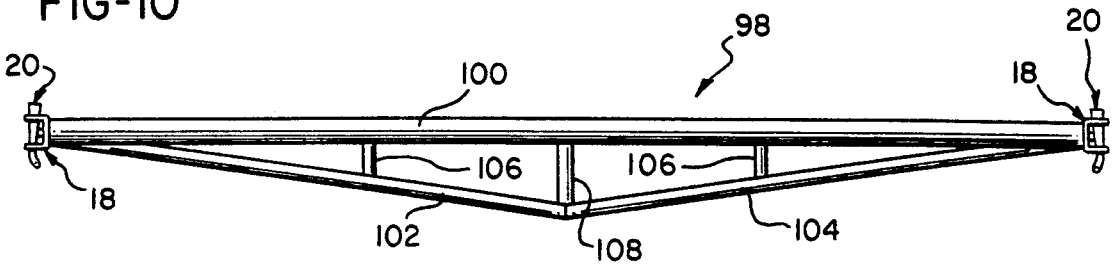
FIG. 10 illustrates one embodiment of a lateral scaffolding support which may be employed according to the invention.

For bearers and runners of shorter length the elongated horizontally disposed supports 14 may be comprised of a single length of steel tubing, as depicted in FIGS. 1–9. For runners of longer length, however, some reinforcing structure may be required. FIG. 10 illustrates a runner 98 of a length greater than six feet which is comprised of a single section of linear, horizontally disposed steel tubing 100, and a pair of braces 102 and 104 that are welded to the ends of the steel tube section 100 proximate the brackets 18, and to each other at the center of the runner 98.

The longitudinally extending runner 98 is a truss formed in a triangular configuration with a single elongated horizontal element 100. The braces 102 and 104 are located on the underside of the horizontal tubing section 100 and form an angle therewith that will vary depending upon the length of the runner. Typically, the angle will be within fifteen degrees. As required for structural strength, vertical intermediate upright supports 106 and 108 are spaced along the length of the runner 98 and are welded to the horizontal tubing section 100 and the steel tubing bracing 102 and 104, as illustrated in FIG. 10.

The connection system of the invention preferably also employs secondary latching openings 24 in addition to the primary latching openings 22. As best illustrated in FIGS. 1 and 2 there are four primary latching openings 22 spaced orthogonally apart at 90 degree intervals within the latching ring 16. Four secondary latching openings 24 are interposed between the primary latching openings 22. Each of the secondary latching openings 24 is formed with an arcuate inner boundary 78 and an arcuate outer boundary 80. The arcuate inner and outer boundaries 78 and 80 are concentric relative to each other and to the upright standard 12. The secondary latching openings 24 are also delineated by laterally separated radial boundaries 82 and 84 that lie at an acute angle relative to each other. Extensions of the radial boundaries 82 and 84 would intersect at the center of the upright standard 12. Each of the secondary openings 24 is thereby configured as a truncated arcuate sector of a circle having inner and outer arcuate boundaries 78 and 80 respectively.

Figure 8:
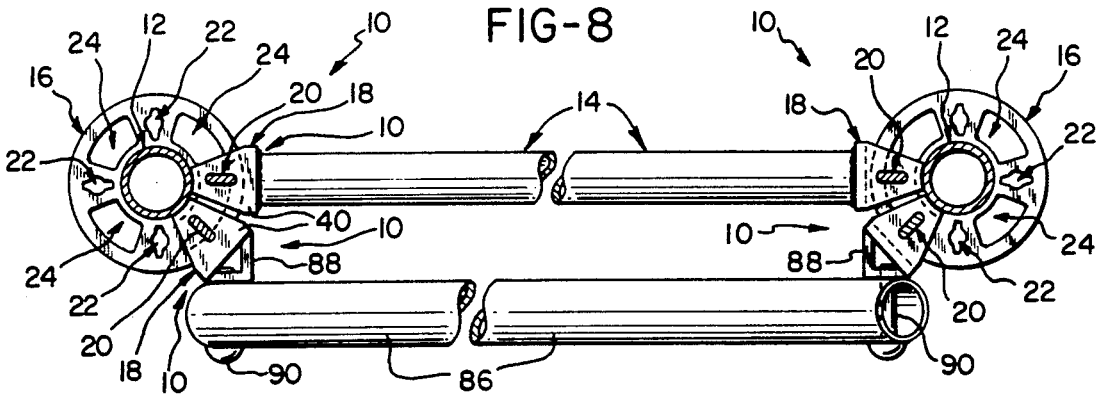
FIG. 8 is a top plan view illustrating connection of both a horizontal runner or bearer and a diagonal brace in the scaffold connection system of the invention.
Figure 9:
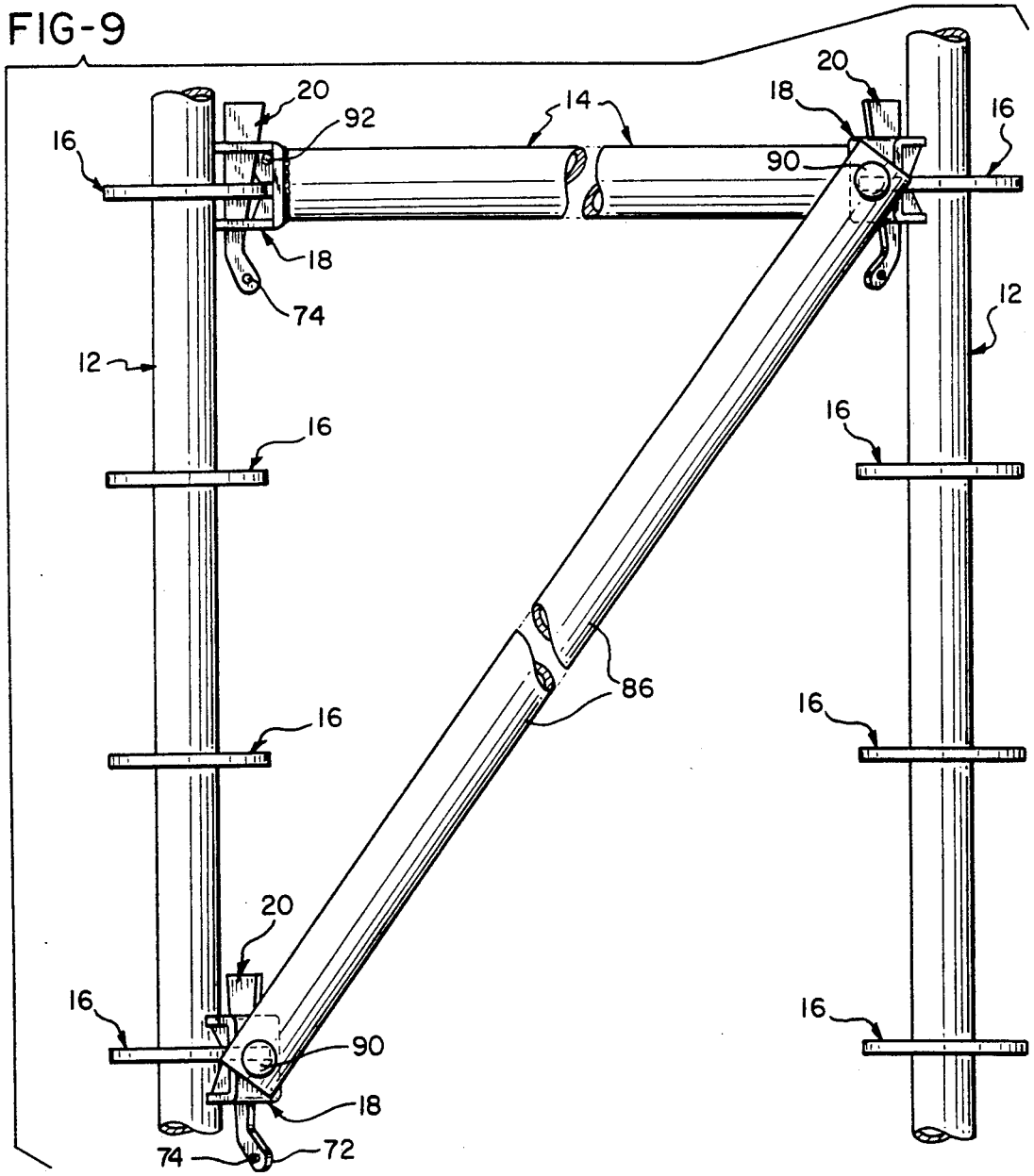
FIG. 9 is a side elevational view of the connected members of FIG. 8.

The primary latching openings 22 are designed to receive brackets 18 that are welded to both ends of horizontally disposed elongated supports 14, such as runners and bearers, as depicted in FIGS. 8 and 9. The flanges 40 and 42 of the brackets 18 of such horizontal supports 14 extend parallel to the alignment of the horizontal supports 14. The secondary latching openings 24, on the other hand, are designed to receive brackets 18 that are secured to both ends of diagonal braces 86, one of which is also illustrated in FIGS. 8 and 9. The diagonal braces 86 cross connect latching rings 16 located at different horizontal elevations on different upright standards 12, as best illustrated in FIG. 9. The flanges 18 that are employed with the diagonal braces 86 are identical to those utilized with the horizontal elongated supports 14. However, the flanges 40 and 42 of the brackets 18 that are secured to the diagonal braces 86 are aligned at an angle relative to the diagonal braces 86.

The diagonal braces 86, like the horizontal runners and bearers 14, are formed of hollow steel tubing, typically two inches in diameter. The brackets 18 are secured to the diagonal braces 86 by means of angle connectors 88 and bolts 90. As best illustrated in FIG. 8, the legs of the angle connectors 88 are welded to opposite ends of the mounting plates 46 of brackets 18. One of the legs of each angle connector 88 is provided with a tapped opening to receive the threaded tip of the shank of the bolt 90. The flanges 40 and 42 of the brackets 18 thereby extend at a forty five degree angle relative to the alignment of the diagonal braces 86, when viewed in a horizontal plane as depicted in FIG. 8. The threaded interconnection between the bolt 90 and the angle connectors 88 allows the angle of inclination of the diagonal brace 86 relative to the horizontal to be adjusted to the lateral spacing between upright standards 12. Also, the flanges 40 and 42 of the brackets 18 that are secured to the ends of the diagonal braces 86 are oriented to extend at an angle relative to the alignment of the diagonal braces 86.

As illustrated in FIGS. 8 and 9, the wedges 20 can be secured in the secondary latching openings 24, as well as in the primary latching openings 22. The secondary latching openings 24 do not include the precision orthogonal aligning features of the primary latching openings 22. Rather the interconnection of the diagonal braces 86 with the upright standards 12 by means of brackets 18 and wedges 20 secured in the secondary latching openings 24 is intended to provide diagonal support so as to enhance the rigidity of the scaffolding structure. The diagonal braces 86 are not designed to reside in orthogonal alignment relative to the upright standards 12, but rather are adapted to reside in inclined dispositions relative to the horizontal.

Undoubtedly, numerous variations and modifications of the invention will become readily apparent to those familiar with commercial scaffolding and structures for supporting commercial scaffolding. Accordingly, the scope of the invention should not be construed as limited to the specific embodiment depicted and described herein, but rather is defined in the claims appended hereto.

I claim:

1. Scaffold support connecting apparatus for use in connecting lateral scaffolding supports to upright scaffolding standards comprising:

an annular latching ring disposed concentrically about an upright standard and permanently secured thereto and formed with a plurality of orthogonally arranged primary latching openings therein, each of which has a central region with radially opposite elongations extending therefrom to define radial inner and outer end surfaces and side surfaces with convex transitions between said central region and said radial elongations and wherein said radial elongations are narrower in transverse width then said central region, a bracket permanently secured to an elongated lateral support and including upper and lower horizontally disposed flanges vertically spaced from each other and each having a longitudinally directed exposed end extremity with a contact edge, said flanges being formed with longitudinally elongated apertures the leading ends of said apertures closest to said contact edges being vertically aligned with each other and the width of the elongated aperture in said upper flange being uniform throughout and equal to said transverse width of said radial elongations of said primary latching openings, a wedge having a uniform thickness in a transverse direction to span the transverse width of said radial elongations in said primary latching openings and an upper portion that decreases in thickness in a longitudinal direction from the top to bottom and the front of which is linear, and a lower portion that forms an obtuse angle with the front of said upper portion, and wherein said wedge is captured in said bracket and is movable in a vertical plane between a disengaged position resting upon said upper flange with said front of said upper wedge portion inclined relative thereto and with said lower wedge portion located between said upper and lower flanges, and a fully engaged position when said latching ring resides between said upper and lower flanges and said bracket is in radial alignment with the radial elongations of a selected primary latching opening, wherein said wedge passes through said apertures in said flanges and through said selected latching opening in said latching ring, whereby said wedge bears against said leading ends of said elongated apertures in said flanges and against said radial outer end surface of said selected primary latching opening, and means on said bracket for limiting movement of said wedge such that the top of said upper portion of said wedge can never rest in a position closer to said upright standard then the bottom of said upper portion.

2. A connecting apparatus for scaffolding supports that include upright standards and members for interconnecting said upright standards comprising:

an annular latching ring permanently secured to extend radially outwardly from an upright standard which extends axially therethrough, said latching ring having a plurality of orthogonally spaced primary latching openings therethrough, each opening having a central region of limited lateral breadth with elongations of uniform transverse width throughout narrower than said breadth of said central region and extending radially in opposite directions to define a radially outwardly facing end surface proximate said standard and a radially inwardly facing end surface remote from said standard, and said end surfaces are separated from each other by a distance greater than said lateral breadth of said central region, a bracket permanently secured to an elongated member for interconnecting said upright standards and including vertically spaced, horizontally disposed upper and lower flanges each having an end extremity with a leading edge thereon for contacting the surface of the aforesaid standard with said latching ring thereon and each of said flanges having a longitudinally elongated aperture formed therein with forward and rearward limiting end surfaces, said elongated aperture in said upper flange having a uniform width throughout equal to said transverse width of said elongations of said primary latching openings, a wedge having a uniform transverse width to span the transverse width of said elongations of said primary latching openings, and an upper portion that has a linear, forwardly facing front and which tapers from top to bottom in a longitudinal direction, and a lower portion that extends from the bottom of said upper wedge portion at an obtuse angle relative to said linear front, and said wedge is captured by said bracket and is movable in a vertical plane between a disengaged position in which said upper wedge portion rests atop said upper flange with said lower wedge portion depending therebeneath and residing above said lower flange, and a fully engaged position when said longitudinally elongated aperture resides in radial and vertical alignment with said radial elongations of a selected primary latching opening, wherein said upper wedge portion extends down through said apertures in said upper and lower flanges and through said selected primary latching opening to bear against said forward limiting end surfaces of said apertures in said upper and lower flanges and against said radially inwardly facing end surfaces of said selected primary latching opening.

3. A connecting apparatus according to claim 2 wherein said bracket is further comprised of means beneath said upper flange for preventing said lower portion of said wedge from lodging between said upper flange and said annular latching ring when said latching ring is disposed to extend between said upper and lower flanges.

4. A connecting apparatus according to claim 2 further comprising a plurality of secondary openings located between said primary openings in said latching ring, each of said secondary openings being configured as a truncated arcuate sector of a circle having inner and outer arcuate boundaries.

5. A connecting apparatus according to claim 2 wherein said flanges of said bracket extend longitudinally from said elongated member.

6. A connecting apparatus according to claim 2 wherein said flanges extend at an angle to the alignment of said elongated member.

7. A connection system for supporting scaffolding to secure laterally extending scaffold support members to upright standards comprising:

an annular latching ring permanently secured perpendicular to a standard wherein said standard passes axially through the center of said ring an said ring defines a plurality of primary latching openings, each of which has a central region of limited breadth with oppositely directed narrower radial elongations of uniform width throughout extending therefrom so as to define a radially outwardly facing end surface proximate to said standard and an opposite radially inwardly facing end surface remote from said standard, a bracket permanently secured to an elongated longitudinally extending member and including upper and lower horizontally disposed flanges projecting from an end of said elongated member to define a gap therebetween to receive said latching ring therewithin, and said upper and lower flanges terminate in extremities having vertically aligned standard abutment edges and longitudinally elongated apertures are formed in each of said upper and lower flanges and define forward bearing edges which ar vertically aligned with each other in spaced separation from said standard abutment edges, and said aperture in said upper flange is of a uniform width throughout equal to said width of said radial elongations of said primary latching openings, a wedge having a transverse width of uniform transverse thickness that spans the width of said radial elongations of said primary latching openings, and an upper portion that has a straight leading edge and a longitudinal width that is wide at the top and tapers to a neck remote from said top, and a lower portion that extends from said neck of said upper portion at an obtuse angle relative to said straight leading edge of said upper portion, and said wedge is carried by said bracket with said lower portion of said wedge projecting through said aperture of said upper flange such that said wedge is rotatable in a vertical plane between a disengaged position in which said upper portion of said wedge rests atop said upper flange with said lower portion of said wedge residing in said gap, and a fully engaged position when said wedge is radially aligned with a selected one of said primary latching openings in said ring, wherein said wedge extends down through said apertures in said flanges and through said radial elongations of said selected primary latching opening in said ring so that said wedge bears radially outwardly against said radially inwardly facing end surface of said selected latching opening in said ring and said leading edge of said wedge bears radially inwardly against said forward bearing edges of said flanges.

8. A connecting system according to claim 7 wherein said longitudinally extending member is adapted to reside in a horizontal disposition and said flanges of said bracket are aligned to extend parallel to the alignment of said longitudinally extending member.

9. A connecting system according to claim 7 wherein said longitudinally extending member is a diagonal brace adapted to reside in an inclined disposition and said flanges of said bracket are oriented to extend at an angle relative to the alignment of said diagonal brace.

10. A connecting system according to claim 7 wherein said longitudinally extending member is a truss formed in a triangular configuration with a single elongated horizontal element.

11. A connection system according to claim 7 wherein said standard abutment edges are configured to conform to the surface of said standard.

12. Scaffold support connecting apparatus for use in connecting lateral scaffolding supports to upright scaffolding standards comprising:

an annular latching ring disposed concentrically about an upright standard and permanently secured thereto and formed with a plurality of orthogonally arranged primary latching openings therein each of which has a central region formed with a generally circular configuration and radially oppositely directed keyway elongations extending therefrom to define radial inner and outer end surfaces and side surfaces with convex transitions between said central region and said radial elongations and wherein said radial elongations are narrower in transverse width then said central region, a bracket permanently secured to an elongated lateral support and including upper and lower horizontally disposed flanges vertically spaced from each other and each having a longitudinally directed exposed end extremity with a contact edge, said flanges being formed with longitudinally elongated apertures the leading ends of said apertures closest to said contact edges being vertically aligned with each other and the width of the elongated aperture in said upper flange being uniform throughout and equal to said transverse width of said radial elongations of said primary latching openings, a wedge having a uniform thickness in a transverse direction to span the transverse width of said radial elongations in said primary latching openings and an upper portion that decreases in thickness in a longitudinal direction from the top to bottom and the front of which is linear, and a lower portion that forms an obtuse angle with the front of said upper portion, and wherein said wedge is captured in said bracket and is movable in a vertical plane between a disengaged position resting upon said upper flange with said front of said upper wedge portion inclined relative thereto and with said lower wedge portion location between said upper and lower flanges, and a fully engaged position when said latching ring resides between said upper and lower flanges and said bracket is in radial alignment with the radial elongations of a selected primary latching opening, wherein said wedge passes through said apertures in said flanges and through said selected latching opening in said latching ring, whereby said wedge bears against said leading ends of said elongated apertures in said flanges and against said radial outer end surface of said selected primary latching opening.

* * * * *